US011805928B2

(12) United States Patent
Brown

(10) Patent No.: US 11,805,928 B2
(45) Date of Patent: Nov. 7, 2023

(54) CONDIMENT BOTTLE SLEEVE DISPENSER APPARATUS

(71) Applicant: Jonathan Brown, Kent, WA (US)

(72) Inventor: Jonathan Brown, Kent, WA (US)

( * ) Notice: Subject to any disclaimer, the term of this patent is extended or adjusted under 35 U.S.C. 154(b) by 323 days.

(21) Appl. No.: 17/344,931

(22) Filed: Jun. 10, 2021

(65) Prior Publication Data

US 2022/0395122 A1 Dec. 15, 2022

(51) Int. Cl.
*A47F 1/06* (2006.01)
*A47G 23/02* (2006.01)

(52) U.S. Cl.
CPC ..... *A47G 23/0241* (2013.01)

(58) Field of Classification Search
CPC ..... A47G 23/0241; A47G 29/087; A47F 1/04; A47F 1/06; B65D 23/06; B65D 23/0842; B65D 83/00; B65D 65/02
USPC ..... 220/737; 222/183; 206/499; 215/395; 221/22, 33, 65, 66, 67, 68, 186, 190
See application file for complete search history.

(56) References Cited

U.S. PATENT DOCUMENTS 1,975,649 A * 10/1934 Reifsnyder ..... A47F 1/085 221/308
2,331,085 A * 10/1943 Sterling ..... B65D 65/16 229/93
D428,339 S 7/2000 Johnston
6,560,335 B2 5/2003 Zohn
8,605,892 B1 12/2013 Owens
2007/0278249 A1 12/2007 Norem
2008/0272135 A1 11/2008 Harris
2009/0050766 A1* 2/2009 Scarton ..... A47G 23/0225 220/737
2016/0059991 A1* 3/2016 Conny ..... B65D 47/147 206/216
2016/0324333 A1* 11/2016 Walton ..... A47F 1/065
2018/0233137 A1 8/2018 Torok
2022/0041333 A1* 2/2022 Foster ..... B65D 23/0842

FOREIGN PATENT DOCUMENTS

WO WO2005056059 6/2005

* cited by examiner

*Primary Examiner* — John K Fristoe, Jr.
*Assistant Examiner* — Elizabeth J Volz

(57) ABSTRACT

A condiment bottle sleeve dispenser apparatus for applying a disposable sleeve to a condiment bottle includes a dispenser body having a body sidewall, a body top rim, and a body bottom rim. The body sidewall has a sidewall inner face and a sidewall outer face. A plurality of bottle sleeves is coupled to the dispenser body. The plurality of bottle sleeves is coupled adjacent the sidewall inner face. Each bottle sleeve has a sleeve bottom aperture and a sleeve top aperture. An innermost bottle sleeve of the plurality of bottle sleeves receives a condiment bottle through the sleeve bottom aperture. A nozzle of the condiment bottle is engageable through the sleeve top aperture. The condiment bottle passes through the dispenser body with the innermost bottle sleeve covering a bottle body of the condiment bottle with the nozzle remaining exposed through the sleeve top aperture.

10 Claims, 6 Drawing Sheets

CONDIMENT BOTTLE SLEEVE DISPENSER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bottle sleeve devices and more particularly pertains to a new bottle sleeve device for applying a disposable sleeve to a condiment bottle. The present device includes a body holding a plurality of sleeves. The condiment bottle may be pushed through one end of the body, catching one of the sleeves, and pulled out through the other end.

(2) Description of Related Art Including Information Disclosed Under 37 CFR 1.97 and 1.98

The prior art relates to bottle sleeve devices. Most existing devices are applied directly to the bottle. These devices lack a holder body with a plurality of sleeves and are rather applied individually. Known devices with many layers of sleeves are applied all at once and an outer sleeve is peeled off between uses.

BRIEF SUMMARY OF THE INVENTION

An embodiment of the disclosure meets the needs presented above by generally comprising a dispenser body having a body sidewall, a body top rim, and a body bottom rim. The body sidewall has a sidewall inner face and a sidewall outer face. A plurality of bottle sleeves is coupled to the dispenser body. The plurality of bottle sleeves is coupled adjacent the sidewall inner face. Each bottle sleeve has a sleeve bottom aperture and a sleeve top aperture. An innermost bottle sleeve of the plurality of bottle sleeves is configured to receive a condiment bottle through the sleeve bottom aperture. A nozzle of the condiment bottle is engageable through the sleeve top aperture. The condiment bottle passes through the body bottom rim and out the body top rim to exit the dispenser body with the innermost bottle sleeve covering a bottle body of the condiment bottle with the nozzle remaining exposed through the sleeve top aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
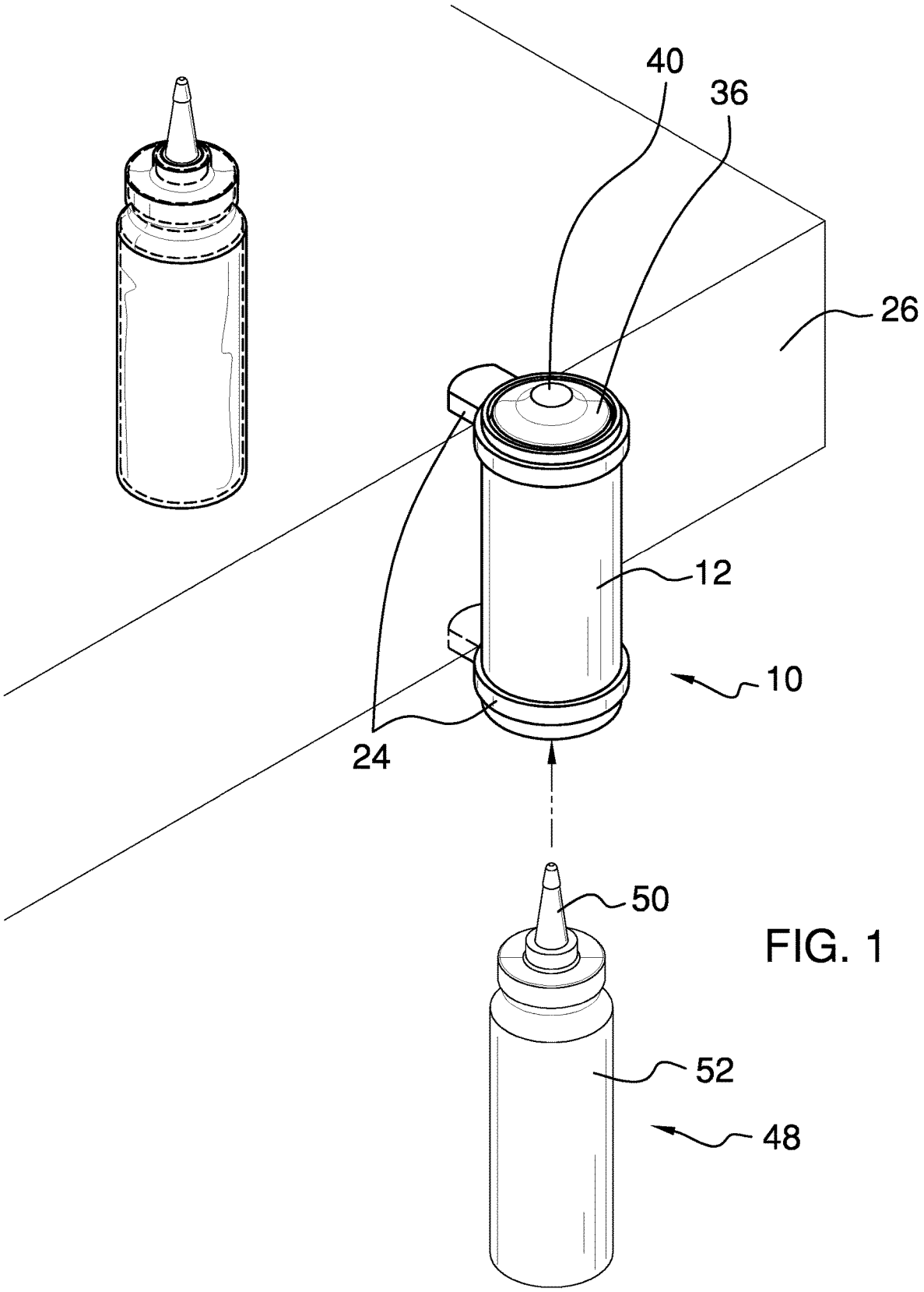
FIG. 1 is an isometric in-use view of a condiment bottle sleeve dispenser apparatus according to an embodiment of the disclosure.
Figure 2:
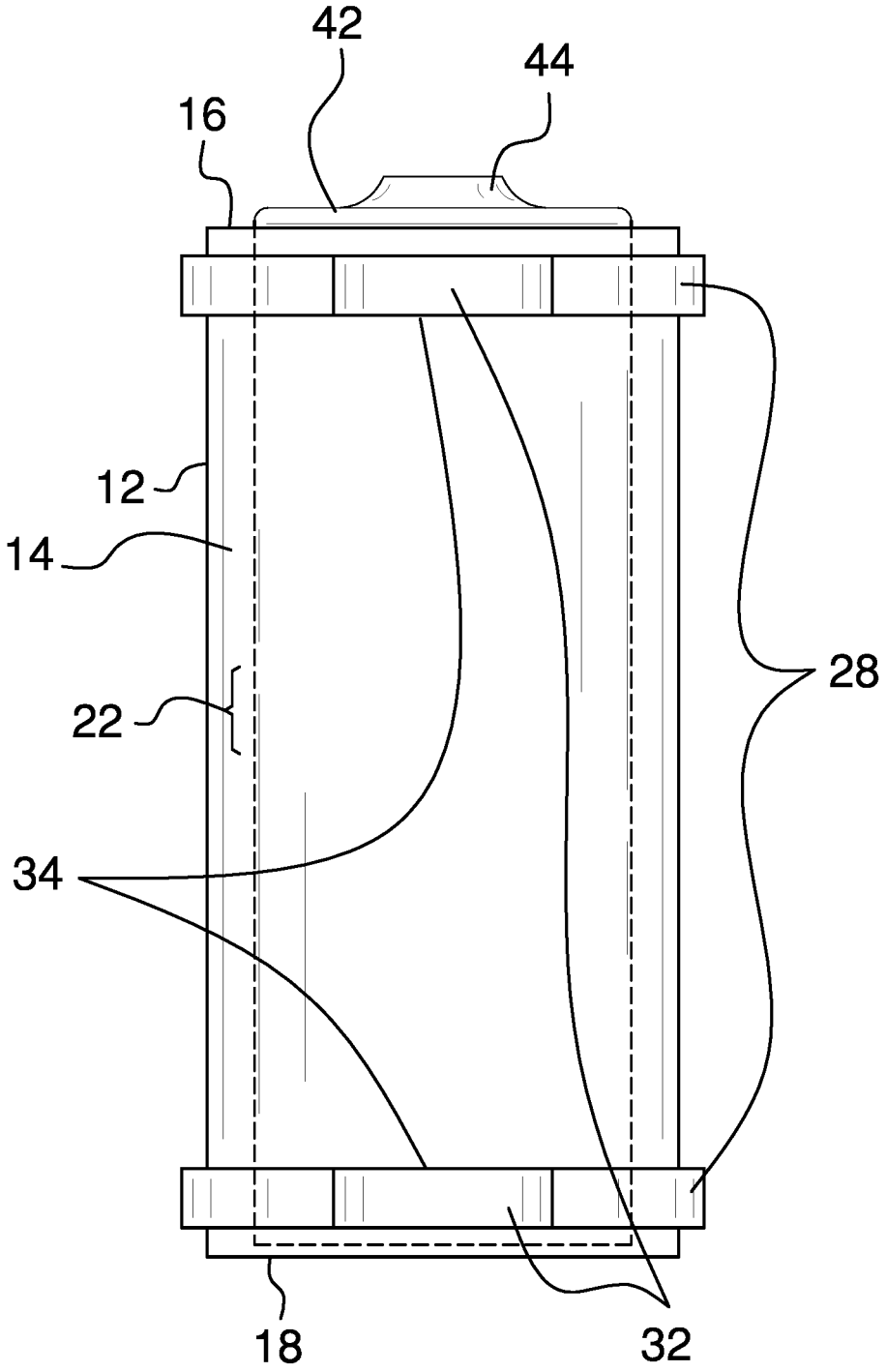
FIG. 2 is a rear elevation view of an embodiment of the disclosure.
Figure 3:
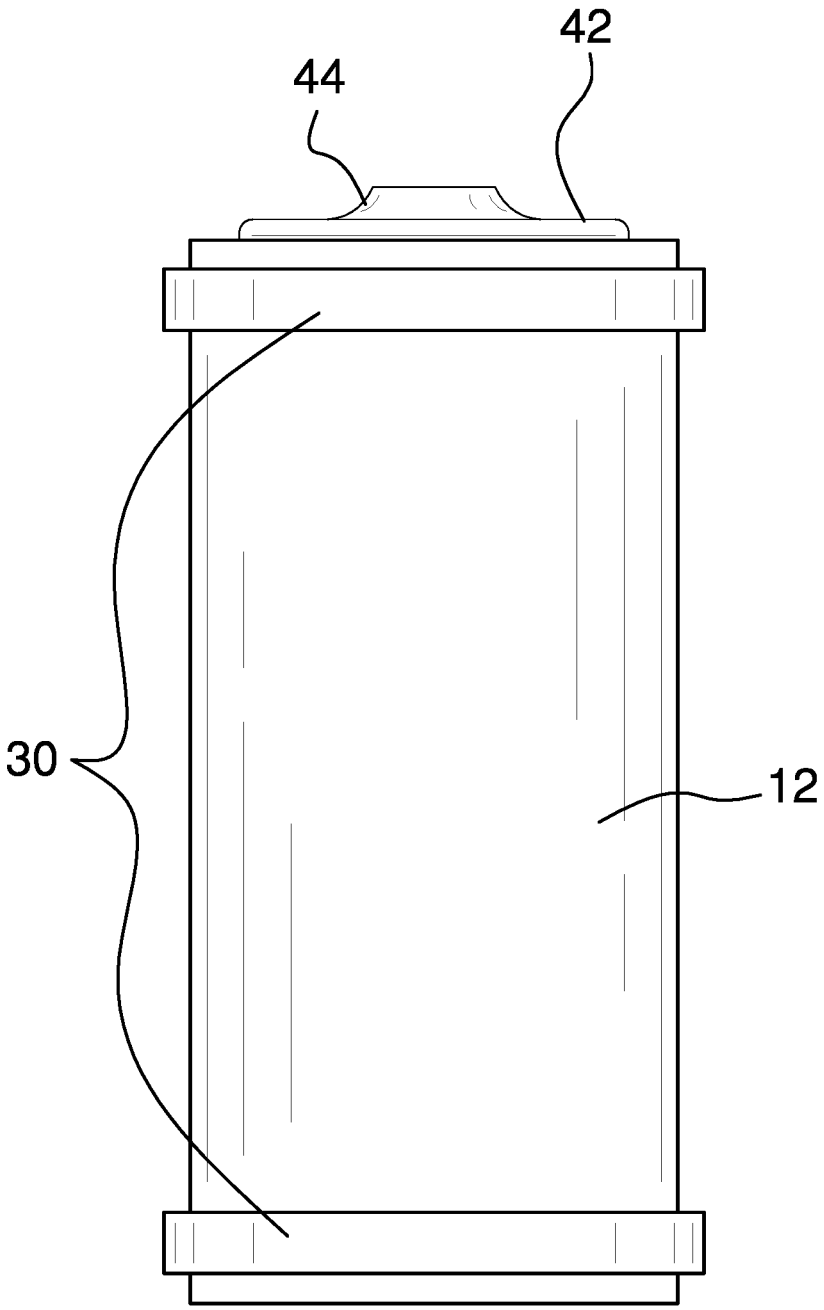
FIG. 3 is a front elevation view of an embodiment of the disclosure.
Figure 4:
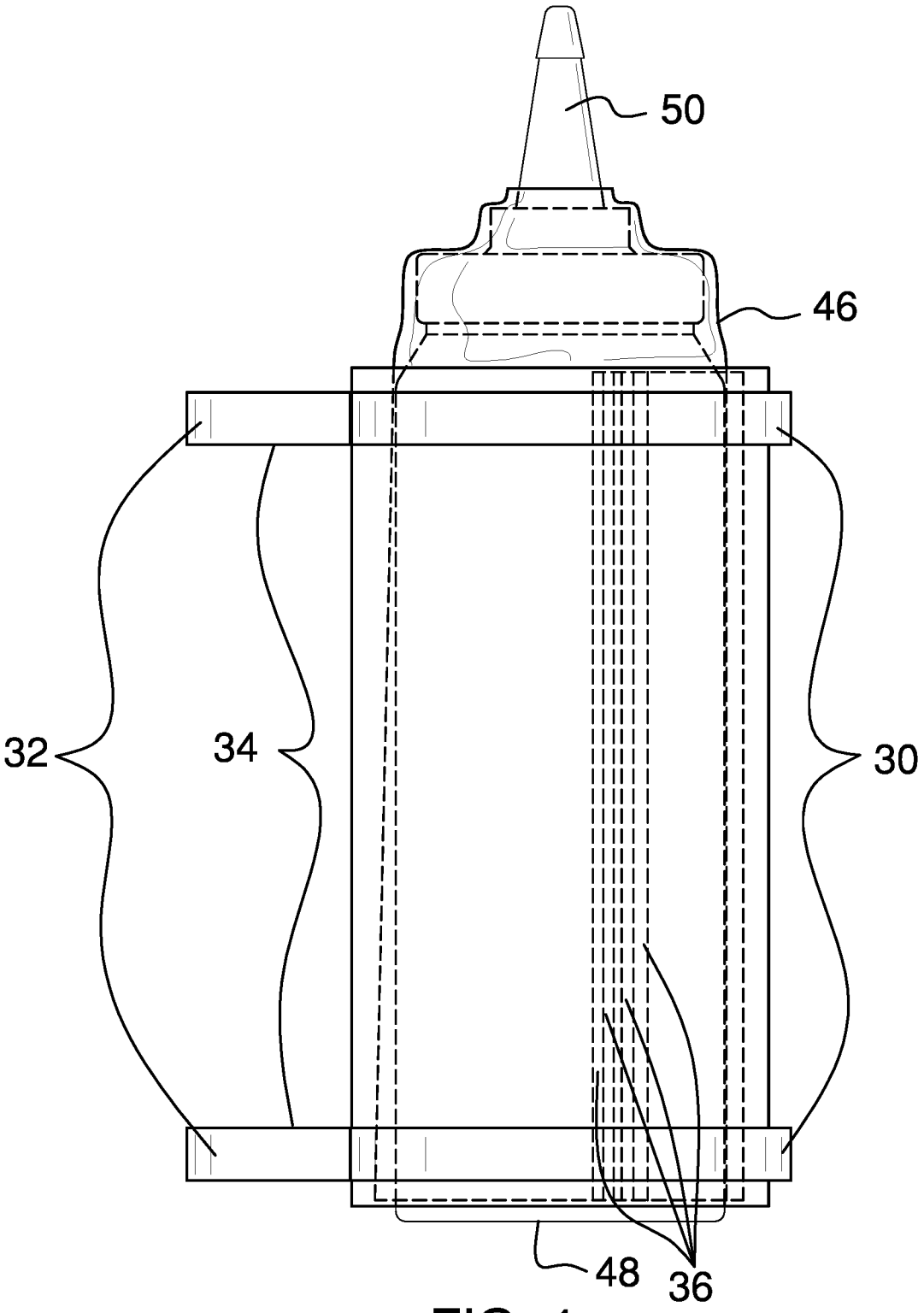
FIG. 4 is a side elevation in-use view of an embodiment of the disclosure.

With reference now to the drawings, and in particular to FIGS. 1 through 6 thereof, a new bottle sleeve device embodying the principles and concepts of an embodiment of the disclosure and generally designated by the reference numeral 10 will be described.

As best illustrated in FIGS. 1 through 6, the condiment bottle sleeve dispenser apparatus 10 generally comprises a dispenser body 12 having a body sidewall 14, a body top rim 16, and a body bottom rim 18. The body sidewall 12 has a sidewall inner face 20 and a sidewall outer face 22. The dispenser body 12 may be cylindrical.

A clamp 24 may be coupled to the dispenser body 12. The clamp 24 is coupled to the body sidewall 14 and is selectively engageable with a table or countertop 26. The clamp 24 may include a pair of clips 28. Each clip 28 has a ring 30 adjustably coupled to the body sidewall 14 and a foot 32 extending perpendicularly from the ring 30. The ring 30 may be press fit on to the sidewall outer face 22 with sufficient friction to prevent movement unless forced in order to securely fasten the dispenser body 24 to the table or countertop 26. The foot 32 of each clip is positioned to squeeze the table or countertop 26 between an inner foot face 34 of each foot 32.

Figure 5:
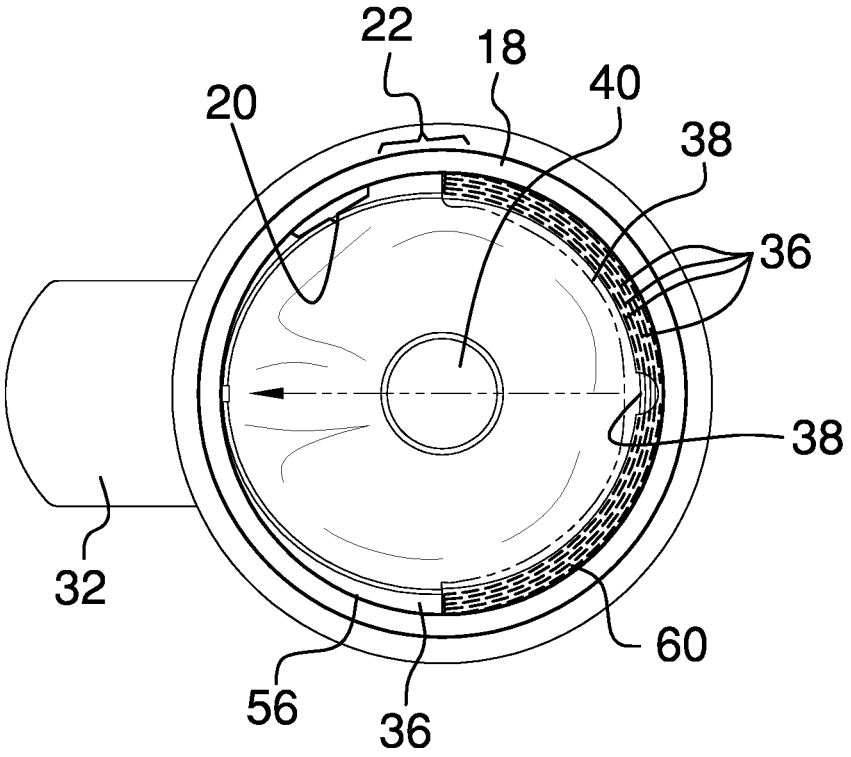
FIG. 5 is a bottom plan view of an embodiment of the disclosure.
Figure 6:
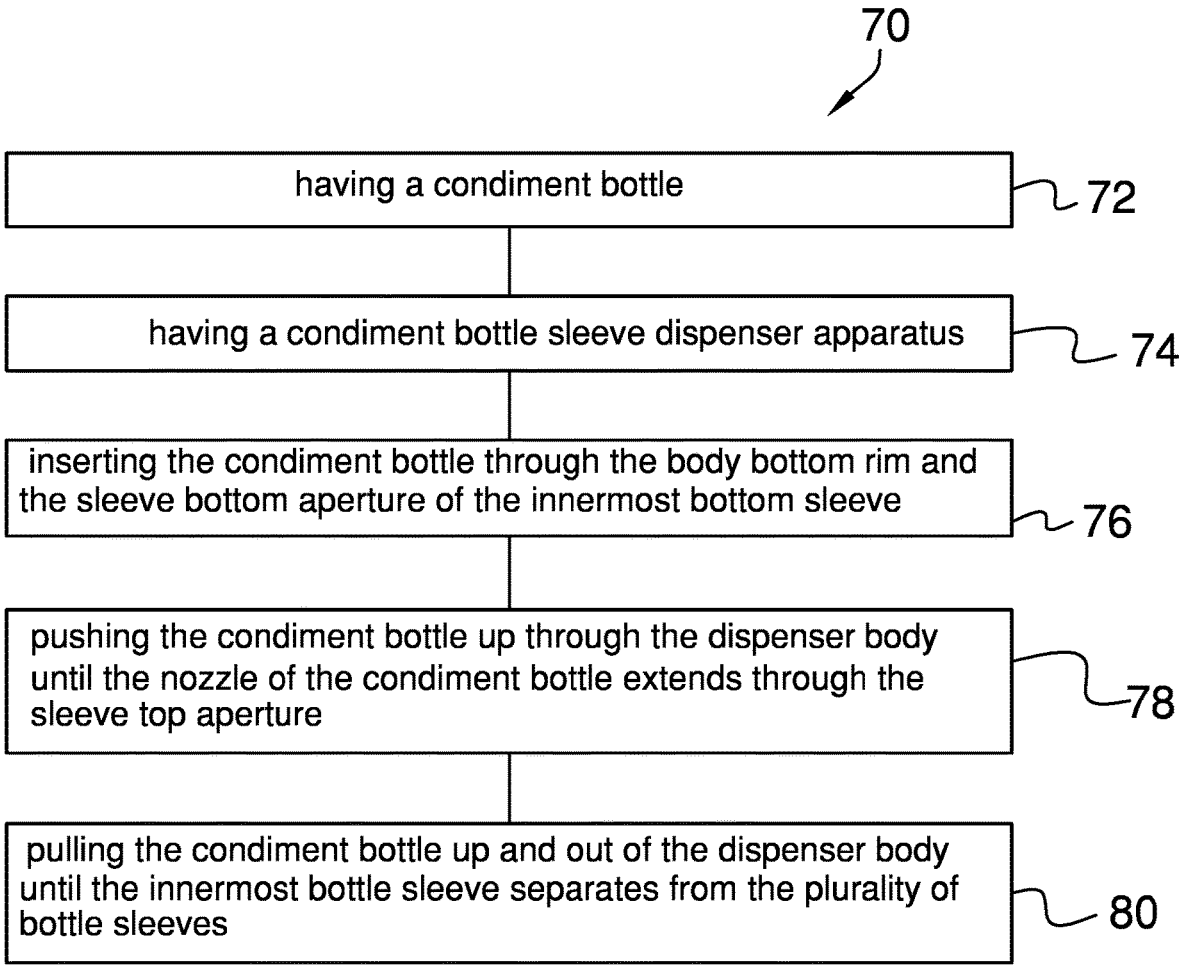
FIG. 6 is a flow chart view of an embodiment of the disclosure.

A plurality of bottle sleeves 36 is coupled to the dispenser body 12. The plurality of bottle sleeves 36 is coupled adjacent the sidewall inner face 20 and arranged in concentric layers as seen in FIG. 5. Each bottle sleeve 36 has a sleeve bottom aperture 38 and a sleeve top aperture 40. The sleeve top aperture 40 may medially extend through a sleeve top side 42 of each bottle sleeve. The sleeve top side 42 may have a raised portion 44 surrounding the sleeve top aperture 40. The raised portion 44 may be curved.

An innermost bottle sleeve 46 of the plurality of bottle sleeves is configured to receive a condiment bottle 48 through the sleeve bottom aperture 38. A nozzle 50 of the condiment bottle is engageable through the sleeve top aperture 40. The raised portion 44 and its shape are designed to more easily guide the nozzle 50 to the sleeve top aperture 40. The condiment bottle 48 passes through the body bottom rim 18 and out the body top rim 16 and exits the dispenser body 12 with the innermost bottle sleeve 46 covering a bottle body 52 of the condiment bottle with the nozzle 50 remaining exposed through the sleeve top aperture 40.

A retaining clip 54 is coupled to the dispenser body 12. The retaining clip 54 is coupled to the body sidewall 14 to secure the plurality of bottle sleeves 36 within the dispenser body 12. The retaining clip 54 may have a fixed half 56 coupled to the sidewall inner face 20 adjacent the body bottom rim 18 and a hinged half 58 coupled to the fixed half 56. The hinged half 58 moves between a stored position against the fixed half 56 and an engaged position against a sleeve edge 60 of the plurality of bottle sleeves as shown in FIG. 5.

In use, the condiment bottle sleeve dispenser apparatus 10 allows for a method of use 70 comprising a step 72 comprising having the condiment bottle 48. A step 74 comprises having the condiment bottle sleeve dispenser apparatus 10. A step 76 comprises inserting the condiment bottle 48 through the body bottom rim 18 and the sleeve bottom aperture 38 of the innermost bottle sleeve. A step 78 comprises pushing the condiment bottle 48 up through the dispenser body 12 until the nozzle 50 of the condiment bottle extends through the sleeve top aperture 40. A step 80 comprises pulling the condiment bottle 48 up out of the dispenser body 12 until the innermost bottle sleeve 46 separates from the plurality of bottle sleeves 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A condiment bottle sleeve dispenser apparatus comprising:

a dispenser body having a body sidewall, a body top rim, and a body bottom rim, the body sidewall having a sidewall inner face and a sidewall outer face; and a plurality of bottle sleeves coupled to the dispenser body, the plurality of bottle sleeves being coupled adjacent the sidewall inner face, each bottle sleeve having a sleeve bottom aperture and a sleeve top aperture, an innermost bottle sleeve of the plurality of bottle sleeves being configured to receive a condiment bottle through the sleeve bottom aperture, a nozzle of the condiment bottle being engageable through the sleeve top aperture, the condiment bottle passing through the body bottom rim and out the body top rim and exiting the dispenser body with the innermost bottle sleeve covering a bottle body of the condiment bottle with the nozzle remaining exposed through the sleeve top aperture.

2. The condiment bottle sleeve dispenser apparatus of claim 1 further comprising a clamp coupled to the dispenser body, the clamp being coupled to the body sidewall and being selectively engageable with a table or countertop.

3. The condiment bottle sleeve dispenser apparatus of claim 2 further comprising the clamp including a pair of clips, each clip having a ring adjustably coupled to the body sidewall and a foot extending perpendicularly from the ring, the foot of each clip being positioned to squeeze the table or countertop.

4. The condiment bottle sleeve dispenser apparatus of claim 1 further comprising a retaining clip coupled to the dispenser body, the retaining clip being coupled to the body sidewall to secure the plurality of bottle sleeves within the dispenser body.

5. The condiment bottle sleeve dispenser apparatus of claim 4 further comprising the retaining clip having a fixed half coupled to the sidewall inner face adjacent the body bottom rim and a hinged half coupled to the fixed half, the hinged half moving between a stored position against the fixed half and an engaged position against a sleeve edge of the plurality of bottle sleeves.

6. The condiment bottle sleeve dispenser apparatus of claim 1 further comprising the sleeve top aperture medially extending through a sleeve top side of each bottle sleeve.

7. The condiment bottle sleeve dispenser apparatus of claim 6 further comprising the sleeve top side having a raised portion surrounding the sleeve top aperture.

8. The condiment bottle sleeve dispenser apparatus of claim 7 further comprising the raised portion being curved.

9. A condiment bottle sleeve dispenser apparatus comprising:

a dispenser body having a body sidewall, a body top rim, and a body bottom rim, the body sidewall having a sidewall inner face and a sidewall outer face;

a clamp coupled to the dispenser body, the clamp being coupled to the body sidewall and being selectively engageable with a table or countertop, the clamp including a pair of clips, each clip having a ring adjustably coupled to the body sidewall and a foot extending perpendicularly from the ring, the foot of each clip being positioned to squeeze the table or countertop;

a plurality of bottle sleeves coupled to the dispenser body, the plurality of bottle sleeves being coupled adjacent the sidewall inner face, each bottle sleeve having a sleeve bottom aperture and a sleeve top aperture, the sleeve top aperture medially extending through a sleeve top side of each bottle sleeve, the sleeve top side having a raised portion surrounding the sleeve top aperture, the raised portion being curved, an innermost bottle sleeve of the plurality of bottle sleeves being configured to receive a condiment bottle through the sleeve bottom aperture, a nozzle of the condiment bottle being engageable through the sleeve top aperture, the condiment bottle passing through the body bottom rim and out the body top rim and exiting the dispenser body with the innermost bottle sleeve covering a bottle body of the condiment bottle with the nozzle remaining exposed through the sleeve top aperture; and a retaining clip coupled to the dispenser body, the retaining clip being coupled to the body sidewall to secure the plurality of bottle sleeves within the dispenser body, the retaining clip having a fixed half coupled to the sidewall inner face adjacent the body bottom rim and a hinged half coupled to the fixed half, the hinged half moving between a stored position against the fixed half and an engaged position against a sleeve edge of the plurality of bottle sleeves.

10. A method of applying a bottle sleeve to a condiment bottle comprising:

having a condiment bottle;

having a condiment bottle sleeve dispenser apparatus comprising:

a dispenser body having a body sidewall, a body top rim, and a body bottom rim, the body sidewall having a sidewall inner face and a sidewall outer face; and a plurality of bottle sleeves coupled to the dispenser body, the plurality of bottle sleeves being coupled adjacent the sidewall inner face, each bottle sleeve having a sleeve bottom aperture and a sleeve top aperture, an innermost bottle sleeve of the plurality of bottle sleeves being configured to receive a condiment bottle through the sleeve bottom aperture, a nozzle of the condiment bottle being engageable through the sleeve top aperture, the condiment bottle passing through the body bottom rim and out the body top rim and exiting the dispenser body with the innermost bottle sleeve covering a bottle body of the condiment bottle with the nozzle remaining exposed through the sleeve top aperture;

inserting the condiment bottle through the body bottom rim and the sleeve bottom aperture of the innermost bottle sleeve;

pushing the condiment bottle up through the dispenser body until the nozzle of the condiment bottle extends through the sleeve top aperture; and pulling the condiment bottle up out of the dispenser body until the innermost bottle sleeve separates from the plurality of bottle sleeves.

* * * * *